US008157423B2

(12) United States Patent
Krätzschmar

(10) Patent No.: US 8,157,423 B2
(45) Date of Patent: Apr. 17, 2012

(54) PLATE FOR INSCRIPTION

(75) Inventor: Andreas Krätzschmar, Ammerthal (DE)

(73) Assignee: Siemens Aktiengesellschaft, Munich (DE)

( * ) Notice: Subject to any disclaimer, the term of this patent is extended or adjusted under 35 U.S.C. 154(b) by 224 days.

(21) Appl. No.: 12/449,294

(22) PCT Filed: Feb. 1, 2007

(86) PCT No.: PCT/DE2007/000178
§ 371 (c)(1),
(2), (4) Date: Mar. 4, 2010

(87) PCT Pub. No.: WO2008/092413
PCT Pub. Date: Aug. 7, 2008

(65) Prior Publication Data
US 2010/0172139 A1 Jul. 8, 2010

(51) Int. Cl.
*F21V 5/00* (2006.01)

(52) U.S. Cl. ..... 362/311.02; 362/603; 362/612

(58) Field of Classification Search ..... 362/602, 362/603, 612, 630, 89, 85, 157, 311.02
See application file for complete search history.

(56) References Cited

U.S. PATENT DOCUMENTS

| | | | | |
|---|---|---|---|---|
| 3,892,959 | A | 7/1975 | Pulles | |
| 4,012,632 | A | 3/1977 | Stone | |
| 4,851,624 | A | 7/1989 | Chestnut | |
| 6,036,326 | A * | 3/2000 | Yoshikawa et al. | 362/23 |
| 6,958,694 | B1 | 10/2005 | Corbosiero, Jr. | |
| 2002/0131261 | A1 * | 9/2002 | Inui et al. | 362/31 |
| 2003/0007344 | A1 | 1/2003 | Parker | |
| 2004/0128882 | A1 | 7/2004 | Glass | |
| 2006/0077650 | A1 | 4/2006 | Barlow | |
| 2009/0021960 | A1 * | 1/2009 | Yeh et al. | 362/612 |
| 2009/0251920 | A1 * | 10/2009 | Kino et al. | 362/602 |

FOREIGN PATENT DOCUMENTS

| | | | |
|---|---|---|---|
| DE | 4442677 | A1 | 6/1996 |
| DE | 19835664 | A1 | 2/2000 |
| DE | 10001053 | C1 | 1/2001 |
| DE | 20103133 | U1 | 6/2001 |
| EP | 1420383 | A2 | 5/2004 |
| EP | 1696404 | A1 | 8/2006 |
| FR | 2516712 | A1 | 5/1983 |
| FR | 2595158 | A2 | 9/1987 |
| WO | WO 03071565 | A1 | 8/2003 |

* cited by examiner

*Primary Examiner* — David V Bruce
(74) *Attorney, Agent, or Firm* — Harness, Dickey & Pierce, P.L.C.

(57) ABSTRACT

A plate is disclosed for inscription for a control unit in automation technology contains a plate-shaped lower part. In at least one embodiment, the lower part has a front flat side, and an inscription element is provided on the front flat side. In at lease one embodiment, the lower part is optically translucent, and an electrical luminous element couples light into the lower part.

18 Claims, 3 Drawing Sheets

PLATE FOR INSCRIPTION

PRIORITY STATEMENT

This application is the national phase under 35 U.S.C. §371 of PCT International Application No. PCT/DE2007/000178 which has an International filing date of Feb. 1, 2007, which designated the United States of America, the entire contents of each of which are hereby incorporated herein by reference.

FIELD

At least one embodiment of the invention generally relates to a plate for inscription for a control device in automation technology.

BACKGROUND

Systems, machines or other devices in the automation technology environment have control devices. Examples of these types of control device are pushbuttons, rotary controls, actuation buttons, levers and the like. The relevant system etc. is controlled by an operator via the control devices. Typically there are also plates acting as displays in the vicinity of these control devices which give the object or the purpose of the corresponding control device or of the controller of the system etc. connected thereto. They thus act as an inscription for the control device. Examples of usual inscriptions are "On/Off", "Pump 3", "Stop" or the like. As a rule the corresponding display plates are about a centimeter in height, a few millimeters deep and a few centimeters wide.

The known plates are manufactured from two plastic panels joined together, of which one is typically black (visible side) and the other is white (rear side). The corresponding plastic panels are joined to each other, e.g. glued, with the front-side (black) part in each case, referred to below as the upper part, having cutouts which form the inscription. After being joined to the lower part, i.e. the other plate, this (white) plate shines in the positions of the inscription through the upper part (black) to its front flat side, i.e. the visible side of the plate.

If an appropriate illumination of the plate is required for improving viewing conditions, this has previously only been able to be achieved with extreme effort. E.g. a corresponding light must be installed in the system.

SUMMARY

At least one embodiment of the invention specifies an improved plate for inscription.

At least one embodiment of the invention is based on the underlying idea of developing an illuminated plate which does not exist in practice.

At least one embodiment is directed to a plate able to be used for an inscription on a control device in automation technology. The plate has a plate-type lower part. The term "lower part" is used here to distinguish it linguistically from an "upper part" mentioned further on in this document. Starting from the usual direction of view, i.e. the direction of the observer in its final installation position, then the observer is looking at the front flat side of the plate. An inscription element is thus accommodated on the front flat side, i.e. the viewing side. The lower part is optically translucent. The plate contains an electrical illuminant coupling light into the plate.

The inventive plate of at least one embodiment thus involves a self-illuminating plate. The inventive construction of the plate of at least one embodiment thus produces a low-cost variant of an illuminated or backlit plate. The structure and thus the volume roughly correspond to the current widely-used non-illuminated variants of a corresponding plate. Plates which are already present in automation technology can thus easily be replaced by the inventive plate.

The inscription element can be accommodated in almost any way on the viewing side, i.e. the front flat side, e.g. in the form of surface lettering, a mask, a painted finish etc. Because of the translucence of the lower part, this is illuminated in a diffuse way as a result of a scattering of the coupled-in light. The front flat side is thus backlit. An optically non-transparent inscription element thus stands out from the rest, i.e. from the non-inscribed part of the visible flat side or vice versa.

The inscription element can be a light-emitting device accommodated in the area of the inscription, and the front flat side can have lower light emission in the area outside the light exit element than in this area. The inscription device/element then appears bright or illuminated; the remaining part of the plate or the visible side appears darker in relation to this, i.e. contrasted.

The light exit element can be an engraving projecting into the inside of the lower part. An optically translucent body lets relatively little light pass through its level surface. If an inscription is then engraved into this for example, the engraving, i.e. the recess extending into the interior, then provides a light exit point. In other words the inscription is illuminated.

The plate can have a plate-shaped upper part. Looking in the normal direction of view, i.e. when looking at the plate, the upper part is arranged above the lower part. The upper part is thus arranged with its rear flat side on the front flat side of the lower part. The upper part has a cutout which forms the inscription, which is then visible on the front flat side of the upper part or of the plate. The structure of such a plate then corresponds in its handling, i.e. installation on the control device etc., to the previously known but non-illuminated plates. These can thus be easily replaced by the inventive plate.

The illuminant can be an LED. Light emitting diodes as illumination elements have the widely-known advantages such as low energy consumption, low heat dissipation, small form factor etc.

The plate-shaped, i.e. rectangular, lower part can have a cutout extending into the interior, with the cutout being large enough to at least partly accommodate the illuminant. In particular when the cutout can completely accommodate the illuminant the plate shape or rectangular shape of the lower part is retained as a surround. In other words the illuminant disappears into the lower part. Thus the form factor does not change in relation to a non-illuminated plate.

The cutout can taper towards the inside of the lower part. Light which is generated in the cutout thus enters into the inside of the lower part through a surface arranged at an angle to the rectangular shape and is thus interrupted at the boundary surface and distributed evenly in the lower part. An evenly illuminated lower part is thus produced in relation to the flat side, which leads to the inscription, e.g. as a breakthrough in the upper part, likewise being evenly illuminated or backlit. To this end the lower part is roughened on its upper surface, so that the light can exit again (homogeneously).

The cutout can also be a conical hole. A holder accepting the illuminant tapering towards the inside of the lower part is thus especially simple to fit into the lower part in manufacturing terms, e.g. by fitting with a 90° drill.

The cutout can be accommodated on the rear flat side of the lower part. The cutout and thereby the illuminant thus form an actual backlighting of the plate. The contact surface between the upper part and the front flat surface of the lower part is not impeded by cutouts or by the illuminant.

The cutout can have a contact offset to the inside of the lower part for connection of the illuminant. The contacting of the illuminant also occurs within the volume or the rectangle of the lower part and does not protrude from the latter. This provides for simple assembly and secure contacting of the illuminant.

The illuminant can also be accommodated for example on a narrow side of the lower part and thus in other words couple light from the side into the lower part.

The plate can contain a circuit for the illuminant, with the circuit being a printed circuit. Printed circuits have an almost invisible height in relation to the display plate and can thus be combined especially simply and advantageously with the plate, without the plate requiring additional space.

The circuit can be especially accommodated on the rear flat side of the lower part. This produces a rectangular plate on the back of which the circuit is accommodated. The rear side is thus the side facing away from the inscription, with which for example it can once again be accommodated on a system or a machine in the vicinity of the control device.

After the printed circuit has been attached to the plate the plate or the circuit can be lacquered on the rear side for the purposes of insulation. The printed circuit or the lower parts with these can be presented almost independent of length since the position of the illuminant as a result of the translucent lower part can fluctuate by around ±10 mm in the transverse direction of the plate without brightness distributions being perceptible on the front flat side. Depending on the length or the width of the display plate, one or more illuminant can also be used, e.g. one per 30 mm length of plate. The printed circuit itself can in this case be equipped for example with one or more light emitting diodes.

The electrically-conducting side of the printed circuit can be fixed to the lower part, e.g. glued. This produces an automatic insulation towards the installation side, i.e. the rear side of the plate through the substrate of the printed circuit.

In particular the plate can have a circuit for wireless supply of energy to the illuminant. A corresponding circuit as a rule comprises a coil and a capacitor and can for example likewise be manufactured as a printed circuit. The plate is thus independent of cabling and can be supplied with energy by standard energy supply elements with voltages off 5-10 V at frequencies of 1100 kHz for example. With wireless energy supply there is above all no installation outlay for the user wishing to attach the plate. The handling of the plates in relation to engraving or attachment of the plates for example remains unchanged compared to the previously known non-illuminated plates. Wireless energy supply is above all very advantageous when high degrees of protection (IP56 and above) are required.

The lower part can have cables attached for energy supplied by an external power supply. As an alternative or in addition the lower part can also feature a cutout for accommodating an energy source. A wireless energy supply is then not necessary, the plate is self-illuminating independently of any additional component. The energy source can in particular be a button cell, which because of its shape, is especially suited for integration into a plate-shaped component. In this case the button cell can naturally be replaceable.

As a rule a plate should light as required or all the time. With the plate however the illuminant can also be able to be operated independently of the switching status of the control device. The illumination can thus for example be switched on or off after actuation of a switch or a pushbutton as control device, in order for example to display the actuation state of the corresponding switch, i.e. the switching state.

BRIEF DESCRIPTION OF THE DRAWINGS

For a further description of the invention the reader is referred to the example embodiments of the drawings. Each drawing shows, in a schematic basic diagram.

DETAILED DESCRIPTION OF THE EXAMPLE EMBODIMENTS

Figure 1:
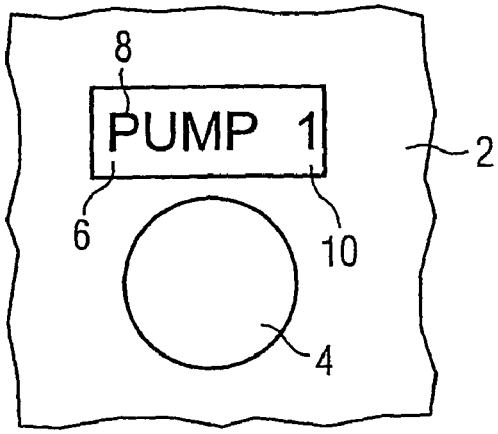
FIG. 1 a part of a system control with pushbuttons and inscription plate.

FIG. 1 shows a cross-section from a system control or from its housing 2. Accommodated in the housing 2 is a pushbutton 4 for activating a pump. Mounted above the pushbutton 4 is a plate 6 for labeling the pushbutton 4, which bears the inscription 8 "Pump 1". The plate 6 is glued onto the housing 2. FIG. 1 shows the overhead view of the housing 2. This direction of view is ideal for an operator not shown in the diagram standing in front of the system control who has access to the pushbutton 4. The front side 10 of the plate 6 is thus visible in FIG. 1.

Figure 2:
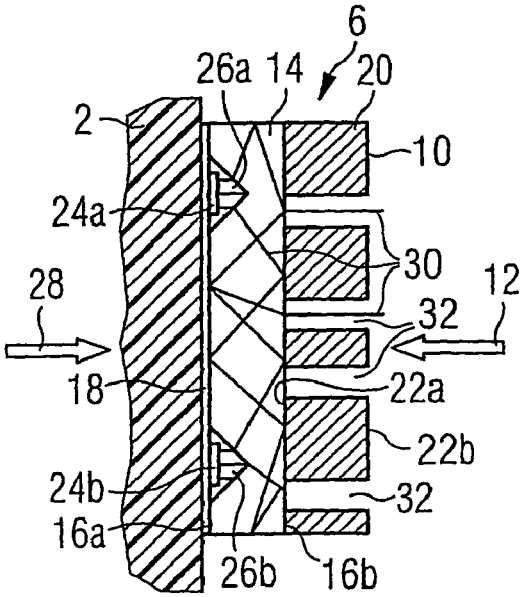
FIG. 2 the plate from FIG. 1 made of two joined plastic parts.

FIG. 2 shows a side view of the housing with plate 6 glued onto it. The direction of view from FIG. 1 is shown by the arrow 12. The plate 6 comprises a lower part 14, glued to the rear side 16 of which is a printed circuit 18, and an upper part 20, which is glued by its rear side 22*a* to the front side 16*b* of the lower part 14. The front side 22*b* of the upper part 20 thus forms the front side 10 of the plate 6. The plate 6 with its printed circuit 18 is thus glued onto the housing 2. Two LEDs (Light Emitting Diodes) 24*a, b* are accommodated on the circuit 18. In the area of the LEDs 24*a, b*, the lower part 14 features holes 26*a, b* on its rear side 16*a* extending into its interior. The holes are embodied in the direction of the arrow 28 in a conical shape with an opening angle of 90°.

Light emitted by the LEDs 24*a, b*, represented by the light beams 30, is thus interrupted on entry into the lower part 14 at the surface of the holes 26*a, b*, which is why it is coupled in at an angle into the translucent lower part and is evenly distributed there.

The upper part 20 is made of a non-transparent material and has breakthroughs 32 in the area of the inscription 8 which extend from the front side 22*b* to the rear side 22*a* and thus to the front side 16*b* of the lower part 14. Light thus penetrates in the form of the light beams 13 from the lower part to the front side of the plate 6 at the positions of the breakthroughs 32, which is why the inscription 8 is illuminated in the direction of view of the arrow 12.

The LEDs 24*a, b* can be permanently switched on. Alternately they are illuminated for a pump, not shown in the diagram, which is switched on, i.e. switching state "1" of the pushbutton 4, and for a pump which is switched off, i.e. switching state "0", they are off.

Figure 3:
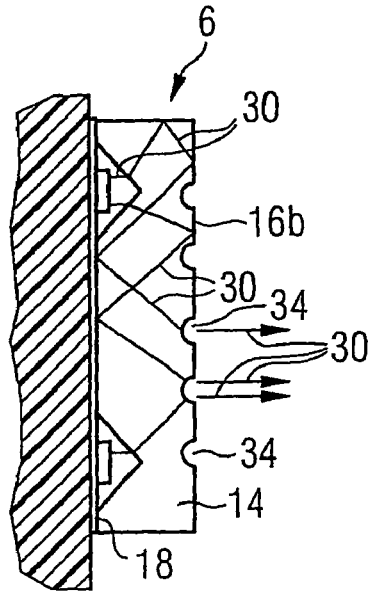
FIG. 3 an alternate embodiment of the plate from FIG. 1 with a single plastic part, FIG. 4 a basic diagram for wireless energy transmission, FIG. 5 a printed circuit in accordance with FIG. 4, FIG. 6 a plate in accordance with FIG. 1 in an embodiment with illuminants accommodated to the side, FIG. 7 a plate in accordance with FIG. 1 with internal contacts for the illuminant in a) a side view and b) a rear view, FIG. 8 a plate in accordance with FIG. 1 with an integrated button cell in a) a side view and b) an overhead view.

FIG. 3 shows an alternate embodiment of a plate 6 which merely has the lower part 14 and no upper part 20. The lower part 14 is thus equipped with an engraving 34 in the area of the inscription 8. The engraving 34 produces coupling-out areas in the lower part 14 or in its front side 16*b*, so that the engraving 34 and thereby the inscription 8 are illuminated at these points in relation to the remaining non-engraved surface (front side 16*b*). This is likewise represented in FIG. 3 by the light beams 30.

Figure 4:
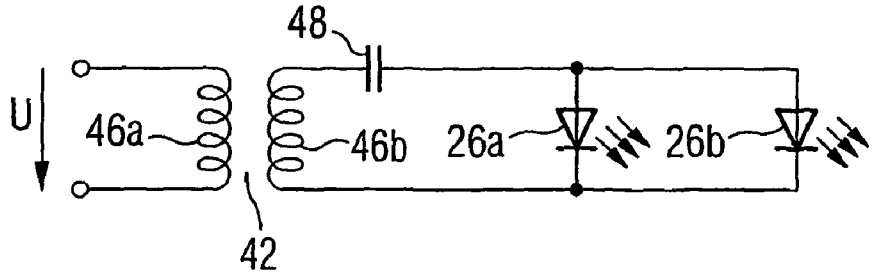

FIG. 4 shows a known basic circuit diagram for an energy transmission circuit 40 for wireless transmission of energy via an air gap 42. A voltage U of frequency f is applied to the input 44 of the circuit 40 which emits an electromagnetic field not shown in the diagram via a send coil 46*a*. A series circuit comprising receive coil 46*b* and capacitor 48 receives the energy in order to drive the two parallel-connected LEDs 24*a, b*.

Figure 5:
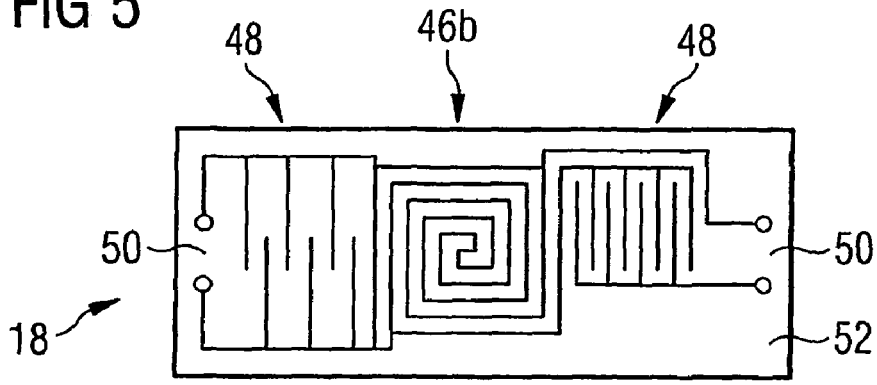

FIG. 5 shows the printed circuit 18 for realizing the receive coil 46*b*, the capacitor 48 and with connections 54 for contacting the LEDs 24*a, b*. FIG. 5 shows the overhead view of the conducting side of the printed circuit 18 which faces towards the lower part 14 in each of FIGS. 2 and 3. A carrier material 52 (substrate) of the printed circuit 18 thus forms an insulation in relation to the housing 2.

Figure 6:
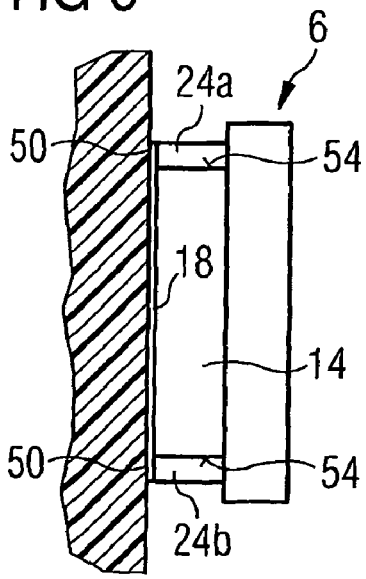

FIG. 6 again shows a plate 6 in accordance with FIG. 1 in which the printed circuit 18 with the contacts 50 protrudes sideways beyond the lower part 14. The LEDs 24*a, b* are arranged in this figure on the circuit board 18 and thus on opposite side surfaces 54 of the lower part 14 and not in its interior.

Figure 7A:
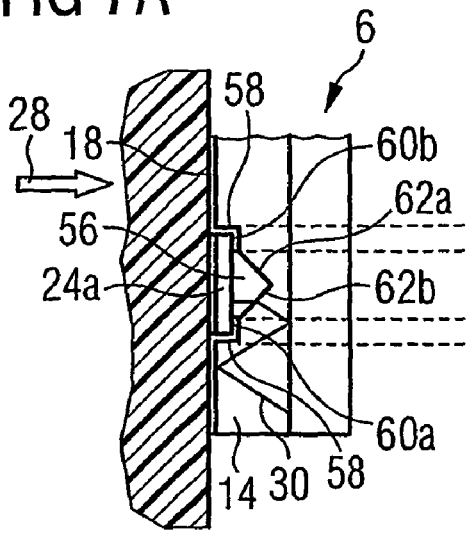

FIG. 7*a* shows a further alternate embodiment of a plate 6 with a cutout 56 for accommodating the light emitting diodes 24*a* in the lower part 14 modified compared to FIGS. 2 and 3. The cutout 56 initially extends along the arrow 28 with a vertical wall section 58 into the lower part 14, so that the LED 24*a* is entirely accommodated in this wall section 58 or disappears within it. Two contact surfaces 60*a, b* then extend from the horizontal wall section 58 to the middle of the cutout 56. The LED 24*a* with its connection contacts, which are not shown in the figure, then lies against these contact surfaces 60*a, b*. The contact surfaces 60*a, b* are extensions of the circuit 18 attached to the rear side 16*a*. In other words this is thus inserted down into the cutout 56.

Figure 7B:
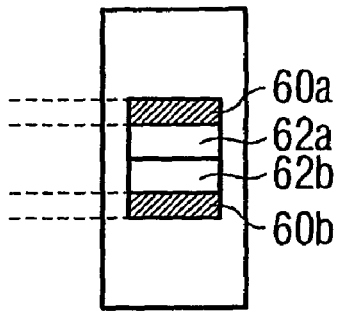

FIG. 7*b* shows the lower part 14 in the direction of view of the arrow 28. Two sloping surfaces 22*a, b* then again adjoin the contact surfaces 60*a, b* towards the middle of the cutout 56 at a 90° angle to each other, which eventually form the cutout 56 extending further into the lower part 14 and are again used to interrupt the light from light beams 30, as described above.

FIG. 8 shows a further variant of a plate 6 in which the printed circuit 18 is not a circuit for accepting wireless energy but is a button cell 64 for supplying energy to the LEDs (not shown in FIG. 8).

Figure 8A:
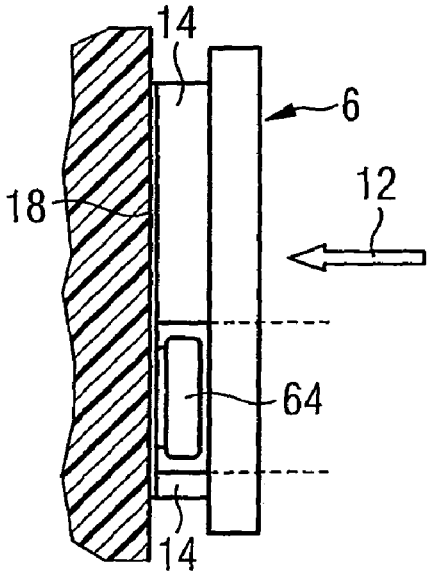
Figure 8B:
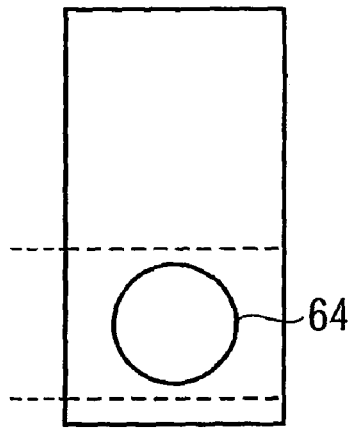

FIG. 8*b* shows the overhead view of FIG. 8*a* in the direction of the arrow 12. The button cell 64 is supported in a battery holder 66 of the lower part 14 and can be replaced.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A plate for inscription for a control device in automation technology, comprising:

a plate-shaped lower part being optically translucent, the plate-shaped lower part including a front flat side and an inscription element attached to the front flat side; and an electrical illuminant, to couple light into the plate-shaped lower part, for self-illumination.

2. The plate as claimed in claim 1, wherein the inscription element includes a light exit element attached in the area of the inscription element, and wherein the front flat side, in an area outside the light exit element, includes relatively lower light emission than the light exit element.

3. The plate as claimed in claim 2, wherein the light exit element is an engraving, extending into an interior of the plate-shaped lower part.

4. The plate as claimed in claim 1, further comprising a plate-shaped upper part with a rear flat side placed on a front flat side of the plate-shaped lower part as the inscription element, the plate-shaped upper part including a cutout forming the inscription on the front flat side.

5. The plate as claimed in claim 1, wherein the electrical illuminant is an LED.

6. The plate as claimed in claim 1, wherein the plate-shaped lower part includes a cutout, extending into its interior, for at least partly accommodating the electrical illuminant.

7. The plate as claimed in claim 6, wherein the cutout narrows towards the interior of the plate-shaped lower part.

8. The plate as claimed in claim 6, wherein the cutout is a conical hole.

9. The plate as claimed in claim 6, wherein the cutout is attached to a rear flat side of the plate-shaped lower part.

10. The plate as claimed in claim 6, wherein the cutout includes a contact, offset in relation to the interior of the plate-shaped lower part for connecting the electrical illuminant.

11. The plate as claimed in claim 1, further comprising a circuit for the electrical illuminant, wherein the circuit is a printed circuit.

12. The plate as claimed in claim 11, wherein the circuit is attached to the rear flat side of the plate-shaped lower part.

13. The plate as claimed in claim 1, further comprising a circuit for wireless energy supply of the electrical illuminant.

14. The plate as claimed in claim 1, wherein the plate-shaped lower part includes a cutout for accommodating an energy source.

15. The plate as claimed in claim 14, wherein the energy source is a button cell.

16. The plate as claimed in claim 1, wherein the electrical illuminant is supplied with energy via a cable.

17. The plate as claimed in claim 1, wherein the electrical illuminant is operable as a function of a switching state of the control device.

18. The plate as claimed in claim 1, wherein the electrical illuminant is attached to a narrow side of the plate-shaped lower part.

* * * * *